US005666824A

United States Patent [19]

Bonaquist

[11] Patent Number: 5,666,824

[45] Date of Patent: Sep. 16, 1997

[54] CRYOGENIC RECTIFICATION SYSTEM WITH STAGED FEED AIR CONDENSATION

[75] Inventor: Dante Patrick Bonaquist, Grand Island, N.Y.

[73] Assignee: Praxair Technology, Inc., Danbury, Conn.

[21] Appl. No.: 617,591

[22] Filed: Mar. 19, 1996

[51] Int. Cl.[6] ..... F25J 3/04

[52] U.S. Cl. ..... 62/646; 62/903; 62/905

[58] Field of Search ..... 62/646, 903, 905

[56] References Cited

U.S. PATENT DOCUMENTS

| | | | |
|---|---|---|---|
| 3,210,951 | 10/1965 | Gaumer, Jr. . | |
| 4,543,115 | 9/1985 | Agrawal et al. | 62/646 |
| 4,662,917 | 5/1987 | Cormier, Sr. et al. | 62/646 |
| 4,704,148 | 11/1987 | Kleinberg . | |
| 4,769,055 | 9/1988 | Erickson . | |
| 4,796,431 | 1/1989 | Erickson . | |
| 4,947,649 | 8/1990 | Agrawal et al. | 62/646 |
| 5,069,699 | 12/1991 | Agrawal | 62/646 |
| 5,282,365 | 2/1994 | Victor et al. | 62/905 X |
| 5,355,681 | 10/1994 | Xu | 62/646 |
| 5,361,590 | 11/1994 | Rathbone | 62/646 |
| 5,392,609 | 2/1995 | Girault et al. . | |
| 5,396,773 | 3/1995 | Ha et al. | 62/646 |
| 5,485,729 | 1/1996 | Higgenbotham | 62/646 |
| 5,551,258 | 9/1996 | Rathbone | 62/646 |

*Primary Examiner*—Christopher Kilner
*Attorney, Agent, or Firm*—Stanley Ktorides

[57] ABSTRACT

A double column cryogenic rectification system for producing lower purity oxygen wherein a minor portion of the feed air is successively condensed in two vertically oriented stages within the lower pressure column before undergoing rectification.

10 Claims, 3 Drawing Sheets

CRYOGENIC RECTIFICATION SYSTEM WITH STAGED FEED AIR CONDENSATION

FIELD OF THE INVENTION

This invention relates generally to cryogenic rectification and more particularly to the production of lower purity oxygen.

BACKGROUND ART

The cryogenic rectification of air to produce oxygen and nitrogen is a well established industrial process. Typically the feed air is separated in a double column system wherein nitrogen shelf or top vapor from a higher pressure column is used to reboil oxygen bottom liquid in a lower pressure column.

The demand for lower purity oxygen is increasing in applications such as glassmaking, steelmaking and energy production. Less vapor boilup in the stripping sections of the lower pressure column, and less liquid reflux in the enriching sections of the lower pressure column are necessary for the production of lower purity oxygen which has an oxygen purity of 97 mole percent or less, than are typically generated by the operation of a double column.

Accordingly, lower purity oxygen is generally produced in large quantities by a cryogenic rectification system wherein feed air at the pressure of the higher pressure column is used to reboil the liquid bottoms of the lower pressure column and is then passed into the higher pressure column. The use of air instead of nitrogen to vaporize the lower pressure column bottoms reduces the air feed pressure requirements, and enables the generation of only the necessary boil-up in the stripping sections of the lower pressure column either by feeding the appropriate portion of the air to the lower pressure column reboiler or by partially condensing a larger portion of the total feed air.

While the conventional air boiling cryogenic rectification system has been used effectively for the production of lower purity oxygen, its ability to generate reflux for supply to the top of the lower pressure column is limited. This results from the fact that condensation of some of the feed air reduces the available vapor for generation of nitrogen reflux in the higher pressure column. More power is consumed because oxygen recovery is reduced as a result of the reduced capability to generate reflux.

Accordingly, it is an object of this invention to provide a cryogenic rectification system for producing lower purity oxygen which employs a double column arrangement and which operates with reduced power requirements over that of conventional systems.

SUMMARY OF THE INVENTION

The above and other objects which will become apparent to one skilled in the art upon a reading of the disclosure are attained by the present invention one aspect of which is:

A method for producing lower purity oxygen by the cryogenic rectification of feed air in a double column having a higher pressure column and a lower pressure column comprising:

(A) passing a first portion of the feed air into the higher pressure column and separating the first feed air portion within the higher pressure column by cryogenic rectification into oxygen-enriched and nitrogen-enriched fluids;

(B) passing oxygen-enriched and nitrogen-enriched fluids from the higher pressure column into the lower pressure column;

(C) partially condensing a second portion of the feed air by indirect heat exchange with fluid within the lower pressure column to produce a first liquid air portion and a first vapor air portion;

(D) at least partially condensing the first vapor air portion by indirect heat exchange with fluid within the lower pressure column at a point above the point where step (C) is carried out to produce a second liquid air portion;

(E) passing the first liquid air portion and the second liquid air portion into the lower pressure column each at a point above the point where step (C) is carried out;

(F) separating the fluids passed into the lower pressure column by cryogenic rectification into nitrogen-rich fluid and oxygen-rich fluid; and (G) recovering oxygen-rich fluid as product lower purity oxygen.

Another aspect of the invention is:

Apparatus for producing lower purity oxygen comprising:

(A) a double column having a first column and a second column;

(B) means for passing a first portion of feed air into the first column;

(C) means for passing fluid from the first column into the second column;

(D) a first heat exchanger within the second column and means for passing a second portion of feed air into the first heat exchanger;

(E) a second heat exchanger within the second column at a point above the first heat exchanger, and means for passing vapor from the first heat exchanger into the second heat exchanger;

(F) means for passing liquid from the first heat exchanger and liquid from the second heat exchanger into the second column each at a point above the first heat exchanger; and (G) means for recovering product lower purity oxygen from the second column.

As used herein the term "lower purity oxygen" means a fluid having an oxygen concentration of 97 mole percent or less.

As used herein, the term "feed air" means a mixture comprising primarily nitrogen and oxygen, such as ambient air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling)

component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "within a column" when referring to heat exchange means functionally within that column, i.e. physically within that column or adjacent that column with liquid from that column passed to the heat exchange device. The liquid may be totally or partially vaporized and the resultant gas or gas-liquid mixture is returned to the column. Preferably the liquid is partially vaporized and the resultant gas-liquid mixture is returned to the column at the same level as the liquid is withdrawn from the column.

DETAILED DESCRIPTION OF THE INVENTION

The invention serves to more nearly eliminate the irreversibilities in the cryogenic distillation system of the lower pressure column of a double column system. This reduces the system energy requirements to a greater degree than is possible with conventional practice. By partially condensing a lower pressure feed air stream in an intermediate heat exchanger in the lower pressure column against partially reboiling column liquid, the operating line of this section of the column is brought closer to the equilibrium line thus reducing the energy requirements of the system. Phase separation of the partially condensed lower pressure feed air provides the opportunity for the incorporation of a second intermediate heat exchanger at a higher level in the lower pressure column. In this second intermediate heat exchanger the separated vapor from the first intermediate heat exchanger is preferably totally condensed against partially reboiled column liquid. The liquid leaving the intermediate heat exchanger does not mix with the entering liquid on the vaporizing side. The liquids produced in each stage of intermediate heat exchange are transferred to the proper levels in the column thus supplementing the normally available reflux. The use of the second intermediate stage of heat exchange further reduces the irreversibilities in the column and thus reduces the energy requirements for the system. Refrigeration requirements for the system are met by turboexpansion of a portion of the air fed to the plant which has been boosted in pressure above that used for partial condensation in the intermediate heat exchangers. A further reduction in energy requirements may be obtained by adding a second pair of intermediate heat exchangers located at a level higher in the column operating in much the same fashion as the first pair. The second pair of intermediate heat exchangers is fed with near saturated lower pressure air from the primary heat exchanger. The first pair of intermediate heat exchangers is fed with near saturated air at a pressure somewhat above the second pair. Refrigeration for the cycle is balanced by turboexpansion of a portion of the air to the plant which has been boosted above that of the first pair of intermediate heat exchangers.

Figure 1:
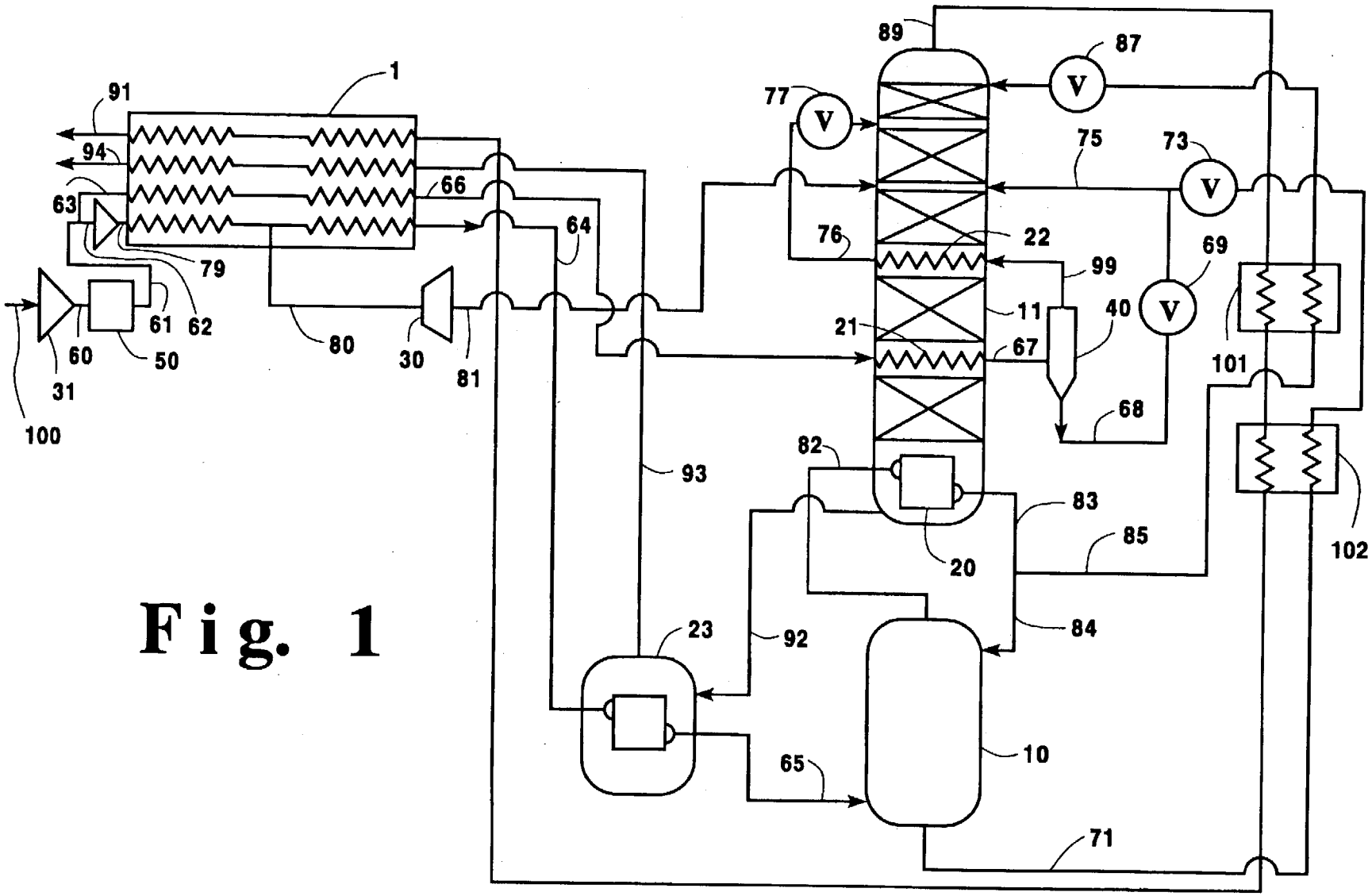
FIG. 1 is a schematic flow diagram of one preferred embodiment of the cryogenic rectification system of the invention.

The invention will be described in greater detail with reference to the Drawings. Referring now to FIG. 1, feed air 100 is compressed to a pressure generally within the range of from 20 to 50 pounds per square inch absolute (psia) by passage through base load compressor 31 and resulting feed air stream 60 is cleaned of high boiling impurities such as water vapor and carbon dioxide by passage through purifier 50. A portion 63 of cleaned, compressed feed air 61, generally comprising from about 20 to 50 percent of the feed air 100, is withdrawn from the feed air for use with the intermediate heat exchangers as will be more fully described later. Remaining feed air stream 62 is compressed by passage through booster compressor 32 to a pressure within the range of from 40 to 100 psia and resulting feed air stream 79 is passed into main heat exchanger 1 wherein it is cooled by indirect heat exchange with return streams.

A portion 80 of feed air stream 79, generally comprising from about 5 to 15 percent of feed air 100, is withdrawn after partial traverse of main heat exchanger 1, turboexpanded by passage through turboexpander 30 to generate refrigeration, and passed as stream 81 into lower pressure column 11. Remaining feed air stream 64, preferably comprising the major portion of the feed air and generally comprising from about 35 to 75 percent of feed air 100, is passed from main heat exchanger 1 to product boiler 23 wherein it is at least partially condensed by indirect heat exchange with boiling product oxygen. Resulting feed air stream 65 is passed as the first feed air portion into first or higher pressure column 10.

First column 10 is the higher pressure column of a double column system which also includes second or lower pressure column 11. Higher pressure column 10 is operating at a pressure within the range of from 40 to 100 psia. Within higher pressure column 10 the first feed air portion is separated by cryogenic rectification into nitrogen-enriched vapor and oxygen-enriched liquid. Nitrogen-enriched vapor is withdrawn from column 10 as stream 82 and passed into main condenser 20 wherein it is condensed by indirect heat exchange with boiling lower pressure column bottom liquid. Resulting nitrogen-enriched liquid 83 is divided into stream 84 which is returned to higher pressure column 10 as reflux, and into stream 85 which is cooled by passage through heat exchanger 101 and passed through valve 87 into lower pressure column 11 as reflux. Oxygen-enriched liquid is withdrawn from higher pressure column 10 as stream 71, cooled by passage through heat exchanger 102 and passed through valve 73 into lower pressure column 11. In the embodiment illustrated in FIG. 1 stream 71 is combined with stream 68 from the first intermediate exchange and this combined stream 75 is passed into the lower pressure column. Second or lower pressure column 11 is operating at a pressure less than that of higher pressure column 10 and within the range of from 15 to 30 psia.

Feed air stream 63 is cooled by passage through main heat exchanger 1 by indirect heat exchange with return streams. Resulting cooled lower pressure feed air stream 66 is passed as a second feed air portion into first intermediate heat exchanger 21 which is located within lower pressure column 11 generally about 2 to 15 equilibrium stages above the heat exchange of bottom reboiler 20. Within first intermediate heat exchanger 21, second feed air portion 66 is partially condensed by indirect heat exchange with vaporizing, preferably partially vaporizing, liquid flowing down column 11 thereby generating upflow vapor for column 11 and producing a first liquid air portion and a first vapor air portion in two phase stream 67 which is passed from first intermediate heat exchanger 21 into phase separator 40.

First vapor air portion 99, which has a nitrogen concentration which exceeds that of stream 66, is passed out from phase separator 40 into second intermediate heat exchanger 22 which is located within lower pressure column 11 above, generally about 1 to 10 equilibrium stages above, first intermediate heat exchanger 21. Within second intermediate heat exchanger 22, first vapor air portion 99 is at least partially and preferably is totally condensed by indirect heat exchange with vaporizing, preferably partially vaporizing, liquid flowing down column 11 thereby generating additional upflow vapor for column 11 and producing a second liquid air portion.

First liquid air portion 68, which has an oxygen concentration which exceeds that of stream 66, is passed out from phase separator 40, through valve 69 and into lower pressure column 11 at a point at or above, generally up to 10 equilibrium stages above, second intermediate heat exchanger 22. As mentioned previously, FIG. 1 illustrates an embodiment wherein stream 68 is combined with stream 71 to form stream 75 which is then passed into column 11. Second liquid air portion 76, which has a nitrogen concentration which exceeds that of stream 66, is passed out from second intermediate heat exchanger 22, through valve 77 and into lower pressure column 11 at a point above, generally from 5 to 20 equilibrium stages above, second intermediate heat exchanger 22. The first and second liquid air portions serve to provide additional reflux liquid into lower pressure column 11 to improve the cryogenic separation within that column.

Within second or lower pressure column 11 the various fluids passed into that column are separated by cryogenic rectification into nitrogen-rich fluid and oxygen-rich fluid. Nitrogen-rich fluid is withdrawn from column 11 as vapor stream 89, warmed by passage through heat exchangers 101, 102 and 1 and passed out of the system as nitrogen stream 1 which may be recovered, in whole or in part, as nitrogen product. Oxygen-rich fluid is withdrawn from column 11 and recovered, in whole or in part, as product lower purity oxygen. In the embodiment illustrated in FIG. 1, oxygen-rich fluid is withdrawn from column 11 as liquid stream 92 which is passed into product boiler 23 wherein it is vaporized by indirect heat exchange with condensing first feed air portion 64. Resulting oxygen-rich vapor stream 93 is warmed by passage through main heat exchanger 1 and recovered as product lower purity oxygen stream 94. If desired, a portion of stream 92 may be recovered directly as product lower purity liquid oxygen.

Figure 2:
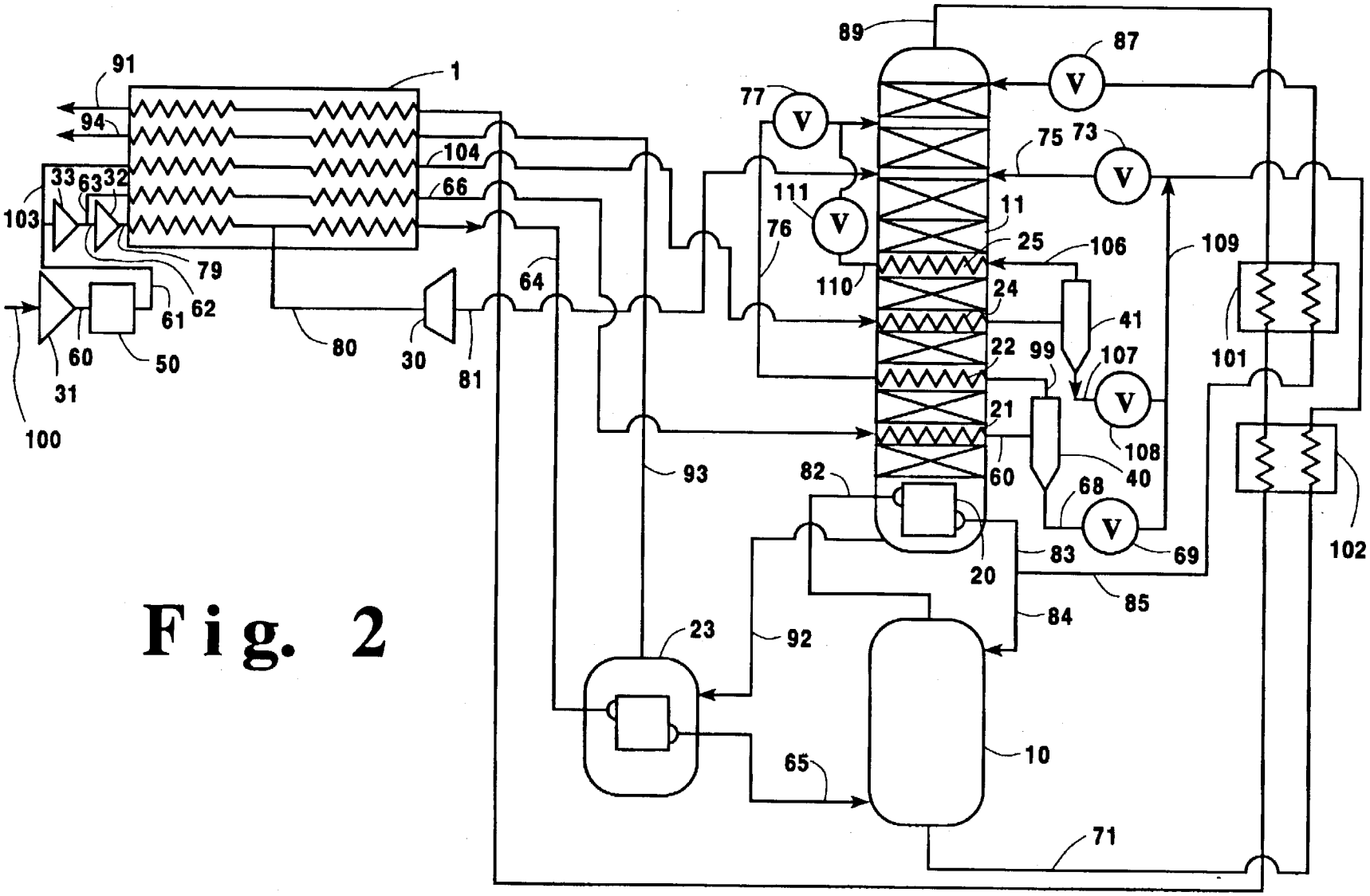
FIG. 2 is a schematic flow diagram of another preferred embodiment of the cryogenic rectification system of the invention.

FIG. 2 illustrates another embodiment of the invention wherein a second pair of intermediate heat exchangers is employed within the lower pressure column. The numerals of FIG. 2 correspond to those of FIG. 1 for the common elements and these common elements will not be described again in detail.

Referring now to FIG. 2 a third portion 103 of feed air stream 61, generally comprising from about 5 to 20 percent of feed air 100, is taken from stream 61 for processing in the second pair of intermediate heat exchangers. Stream 61 is then compressed to a higher pressure by passage through compressor 33 before being processed as described in accordance with the embodiment illustrated in FIG. 1. Feed air stream 103 is warmed by passage through main heat exchanger 1 and resulting stream 104 is partially condensed in third intermediate heat exchanger 24 which is located within lower pressure column 11 generally about 1 to 10 equilibrium stages above second intermediate heat exchanger 22. Within third intermediate heat exchanger 24, feed air stream 104 is partially condensed by indirect heat exchange with vaporizing, preferably partially vaporizing, liquid flowing down column 11 thereby generating upflow vapor for column 11 and producing a third liquid air portion and a further vapor air portion in two phase stream 105 which is passed from third intermediate heat exchanger 24 into phase separator 41. Further vapor air portion 106, which has a nitrogen concentration exceeding that of stream 103, is passed out from phase separator 41 into fourth intermediate heat exchanger 25 which is located within lower pressure column 11 above, generally about 1 to 10 equilibrium stages above, third intermediate heat exchanger 24. Within fourth intermediate heat exchanger 25, further vapor air portion 106 is at least partially and preferably is totally condensed by indirect heat exchange with vaporizing liquid flowing down column 11 thereby generating additional upflow vapor for column 11 and producing a fourth liquid air portion.

Third liquid air portion 107, which has an oxygen concentration exceeding that of stream 103, is passed through valve 108 and combined with stream 68 to form stream 109 which then is combined with stream 71 to form stream 75 which is processed as described above. Fourth liquid air portion 110, which has a nitrogen concentration exceeding that of stream 103, is passed out from fourth intermediate heat exchanger 25, through valve 111, and combined with stream 77 which is processed as described above.

Figure 3:
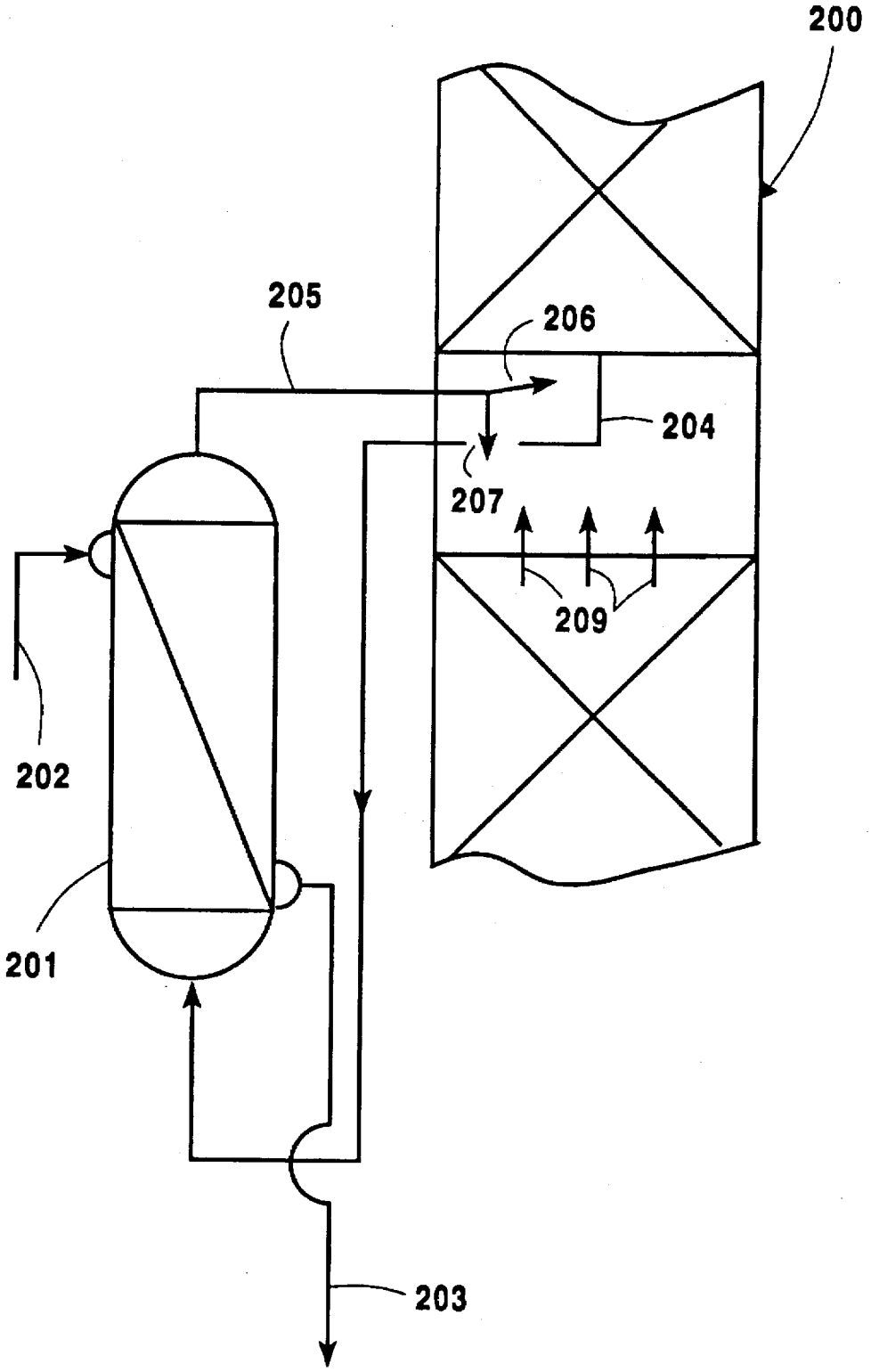
FIG. 3 is a representation of a preferred heat exchange arrangement in the practice of the invention wherein the defined heat exchange within a column takes place outside the column shell.

While FIGS. 1 and 2 illustrate the heat exchange associated with heat exchangers 21, 22, 24 and 25 as occurring physically within the shell of the column, this is done to simplify the illustration of the method of the invention. In many instances it is expected that one or more such heat exchangers will be located physically outside the shell of the column, i.e. functionally within the column. FIG. 3 illustrates one arrangement in generalized form of such a heat exchanger functionally within the column.

Referring now to FIG. 3, liquid descending within column 200 is collected and withdrawn from the column as stream 204. Means for collection and withdrawal of the liquid are well known to those knowledgeable in the design of distillation equipment. Liquid stream 204 is introduced to heat exchanger 201 which may be a brazed aluminum heat exchanger. As liquid 204 traverses heat exchanger 201, it is at least partially vaporized by indirect heat exchange with a fluid 202 which is at least partially condensed. Fluid 202 represents the vapor flow into the heat exchanger, e.g. stream 66 or stream 99 of FIG. 1. Streams 202 and 204 flow in a counter-current fashion within heat exchanger 201. Partially vaporized liquid 205 exits heat exchanger 201 and is delivered back to column 200. Preferably the partially vaporized liquid is returned to the column in such a fashion that the vapor portion 206 is able to mix with vapor 209 rising within the column from below the point where liquid 204 was originally withdrawn. The means for accomplishing this are commonly employed in distillation column design when a two-phase stream is introduced to an intermediate location within the column. The liquid portion 207 of stream 205 is disengaged from the vapor portion and is preferably distributed to those mass transfer elements such as packing or trays immediately below the level from where liquid 204 was originally withdrawn. The means for disengaging the liquid from the vapor and for distributing the liquid as described are commonly employed in distillation column design. Although from a functional viewpoint it is preferred to employ all of the column downflowing liquid for stream 204, some design circumstances may dictate using only a portion of the downflowing liquid for this purpose. As mentioned, stream 202 is at least partially condensed by the heat exchange within heat exchanger 201. Fluid in stream 203 is passed into the column. Stream 203 corresponds, for example, to stream 67 or stream 76 of FIG. 1.

Although the invention has been described in detail with reference to certain preferred embodiments, those skilled in the art will recognize that there are other embodiments of the invention within the spirit ad the scope of the claims.

I claim:

1. A method for producing lower purity oxygen by the cryogenic rectification of feed air in a double column having a higher pressure column and a lower pressure column comprising:

(A) passing a first portion of the feed air into the higher pressure column and separating the first feed air portion within the higher pressure column by cryogenic rectification into oxygen-enriched and nitrogen-enriched fluids;

(B) passing oxygen-enriched and nitrogen-enriched fluids from the higher pressure column into the lower pressure column;

(C) partially condensing a second portion of the feed air by indirect heat exchange with fluid within the lower pressure column to produce a first liquid air portion and a first vapor air portion;

(D) at least partially condensing the first vapor air portion by indirect heat exchange with fluid within the lower pressure column at a point above the point where step (C) is carried out to produce a second liquid air portion;

(E) passing the first liquid air portion and the second liquid air portion into the lower pressure column each at a point above the point where step (C) is carried out with the second liquid air portion passed into the lower pressure column above where the first liquid air portion is passed into the lower pressure column;

(F) separating the fluids passed into the lower pressure column by cryogenic rectification into nitrogen-rich fluid and oxygen-rich fluid; and (G) recovering oxygen-rich fluid as product lower purity oxygen.

2. The method of claim 1 further comprising:

(H) partially condensing a third portion of the feed air by indirect heat exchange with fluid within the lower pressure column to produce a third liquid air portion and a further vapor air portion;

(I) at least partially condensing the further vapor air portion by indirect heat exchange with fluid within the lower pressure column at a point above the point where step (H) is carried out to produce a further liquid air portion; and (J) passing the third liquid air portion and the fourth liquid air portion into the lower pressure column each at a point above the point where step (H) is carried out.

3. The method of claim 1 wherein oxygen-rich fluid is withdrawn from the lower pressure column as liquid and vaporized by indirect heat exchange with feed air prior to recovery.

4. The method of claim 1 further comprising recovering nitrogen-rich fluid as product nitrogen.

5. Apparatus for producing lower purity oxygen comprising:

(A) a double column having a first column and a second column;

(B) means for passing a first portion of feed air into the first column;

(C) means for passing fluid from the first column into the second column;

(D) a first heat exchanger within the second column and means for passing a second portion of feed air into the first heat exchanger;

(E) a second heat exchanger within the second column at a point above the first heat exchanger, and means for passing vapor from the first heat exchanger into the second heat exchanger;

(F) means for passing liquid from the first heat exchanger and liquid from the second heat exchanger into the second column each at a point above the first heat exchanger with liquid from the second heat exchanger passed into the second column above where liquid from the first heat exchanger passed into the second column; and (G) means for recovering product lower purity oxygen from the second column.

6. The apparatus of claim 5 further comprising a third heat exchanger within the second column, means for passing a third portion of feed air into the third heat exchanger, a fourth heat exchanger within the second column at a point above the third heat exchanger, means for passing vapor from the third heat exchanger into the fourth heat exchanger, and means for passing liquid from the third heat exchanger and from the fourth heat exchanger into the second column each at a point above the third heat exchanger.

7. The apparatus of claim 5 further comprising a product boiler wherein the means for passing the first portion of feed air into the first column and the means for recovering product lower purity oxygen from the second column both include the product boiler.

8. The apparatus of claim 5 further comprising means for recovering product nitrogen from the second column.

9. A method for producing lower purity oxygen by the cryogenic rectification of feed air in a double column having a higher pressure column and a lower pressure column comprising:

(A) passing a first portion of the feed air into the higher pressure column and separating the first feed air portion within the higher pressure column by cryogenic rectification into oxygen-enriched and nitrogen-enriched fluids;

(B) passing oxygen-enriched and nitrogen-enriched fluids from the higher pressure column into the lower pressure column;

(C) partially condensing a second portion of the feed air by indirect heat exchange with fluid within the lower pressure column to produce a first liquid air portion and a first vapor air portion;

(D) at least partially condensing the first vapor air portion by indirect heat exchange with fluid within the lower pressure column at a point above the point where step (C) is carried out to produce a second liquid air portion;

(E) passing the first liquid air portion and the second liquid air portion into the lower pressure column each at a point above the point where step (C) is carried out;

(F) separating the fluids passed into the lower pressure column by cryogenic rectification into nitrogen-rich fluid and oxygen-rich fluid;

(G) recovering oxygen-rich fluid as product lower purity oxygen;

(H) partially condensing a third portion of the feed air by indirect heat exchange with fluid within the lower pressure column to produce a third liquid air portion and a further vapor air portion;

(I) at least partially condensing the further vapor air portion by indirect heat exchange with fluid within the lower pressure column at a point above the point where step (H) is carried out to produce a further liquid air portion; and (J) passing the third liquid air portion and the fourth liquid air portion into the lower pressure column each at a point above the point where step (H) is carried out.

10. Apparatus for producing lower purity oxygen comprising:

(A) a double column having a first column and a second column;

(B) means for passing a first portion of feed air into the first column;

(C) means for passing fluid from the first column into the second column;

(D) a first heat exchanger within the second column and means for passing a second portion of feed air into the first heat exchanger;

(E) a second heat exchanger within the second column at a point above the first heat exchanger, and means for passing vapor from the first heat exchanger into the second heat exchanger;

(F) means for passing liquid from the first heat exchanger and liquid from the second heat exchanger into the second column each at a point above the first heat exchanger;

(G) means for recovering product lower purity oxygen from the second column; and (H) a third heat exchanger within the second column, means for passing a third portion of feed air into the third heat exchanger, a fourth heat exchanger within the second column at a point above the third heat exchanger, means for passing vapor from the third heat exchanger into the fourth heat exchanger, and means for passing liquid from the third heat exchanger and from the fourth heat exchanger into the second column each at a point above the third heat exchanger.

* * * * *